US008042483B2

(12) United States Patent
Huyer et al.

(10) Patent No.: US 8,042,483 B2
(45) Date of Patent: Oct. 25, 2011

(54) APPARATUS FOR CONTROL OF STATOR WAKES

(75) Inventors: Stephen A. Huyer, Saunderstown, RI (US); Daniel L. Macumber, Thornton, CO (US); Anuradha Annaswamy, West Newton, MA (US); David N. Beal, Providence, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 274 days.

(21) Appl. No.: 12/562,542

(22) Filed: Sep. 18, 2009

(65) Prior Publication Data

US 2011/0070783 A1 Mar. 24, 2011

(51) Int. Cl.
*B63G 8/08* (2006.01)

(52) U.S. Cl. ..... 114/337; 440/66

(58) Field of Classification Search ..... 114/337, 114/338; 440/66; 415/119
See application file for complete search history.

(56) References Cited

U.S. PATENT DOCUMENTS

| | | | | |
|---|---|---|---|---|
| 4,705,452 | A * | 11/1987 | Karadimas | 415/115 |
| 5,209,438 | A * | 5/1993 | Wygnanski | 244/203 |
| 6,439,838 | B1 * | 8/2002 | Crall et al. | 415/119 |
| 6,827,551 | B1 * | 12/2004 | Duffy et al. | 415/119 |
| 7,150,434 | B1 * | 12/2006 | Bandyopadhyay | 244/130 |
| 2007/0274823 | A1 * | 11/2007 | Borchers et al. | 415/115 |
| 2008/0194155 | A1 * | 8/2008 | Gaudin | 440/67 |

* cited by examiner

*Primary Examiner* — Stephen Avila
(74) *Attorney, Agent, or Firm* — James M. Kasischke; Jean-Paul A. Nasser; Michael B. Stanley

(57) ABSTRACT

The invention as disclosed is an apparatus that controls the wake of stator blades on an underwater vehicle. The apparatus comprises one or more stator blades each with a movable trailing edge that when actuated in a controlled manner produces a periodic flapping motion upstream of a propulsion rotor. The controlled periodic flapping of the trailing edge the fills the stator blade wake enough to overcome the stator blade's own drag and fill its wake deficit. This has the effect of reducing the blade rate tonal noise of the propulsion rotor.

4 Claims, 2 Drawing Sheets

APPARATUS FOR CONTROL OF STATOR WAKES

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION (1) Field of the Invention

The present invention is directed to stator blades and rotor blades on an underwater vehicle. In particular, the present invention is directed to an apparatus to reduce stator blade rate tonal noise through altering the mean and instantaneous characteristics of the rotor blade inflow.

(2) Description of the Prior Art

Conventional stator blades on the hulls of underwater vehicles add swirl to the propeller inflow that increases the efficiency of the propeller through the cancellation of the swirl generated by the propeller. However, stator blades and other upstream appendages also produce discrete wakes due to the velocity deficit caused by viscosity of the fluid moving over the stator blade surface. When a propeller blade meets these velocity deficits during the rotation of the propeller, sudden variations of force are produced. These regular unsteady force disturbances create a recognizable noise, the blade rate signature. This noise can be used to detect and identify the vehicle. Experiments using "swirl inducing stator upstream of propeller propulsors" have highlighted the effect of sharp stator wakes on propulsor radiated noise. Anytime the inflow to the rotor is circumferentially unsteady, caused by the wakes of upstream appendages, control fins, guide vanes, or stators, for instance, the loading on the rotor blades is unsteady and periodic with the blade rate. In the case of swirl inducing stator upstream of propeller propulsors the sharp wake deficits behind the stators result in unsteady loading and distinguishable peaks in the noise spectra at harmonics of the blade rate, with the frequency of the peaks in the spectra dependent on the number of stator and rotor blades. This radiated noise signature can be used to classify vehicles using sonar.

Swimming and flying animals use flapping wings or fins to produce thrust and maneuvering forces. They do this through the creation of an alternating vortex wake, similar to the drag wake seen behind cylinders in a flow but with opposite sign. The discrete vortices form a thrust jet through the center of the vortex street which accelerates fluid away from the fin, accelerating the animal forward. This same effect can be used to fill a stator or guide vane wake, but rather than create a vortex wake powerful enough to produce net thrust as is the case with animal fins, the stators can be flapped just enough to overcome its own drag and fill its wake deficit.

Currently, there is a need to reduce or eliminate the radiated noise signature of rotors through the use of a simple flapping motion of the trailing edge of a stator blade in order to fill its mean wake deficit to reduce unsteady loading on the rotor blades. Interaction between the rotor blades and the discrete vortices in the flapping stator wake may increase unsteady loading on the rotor without careful timing. Through active control of the stator oscillations the timing of rotor blades passing through the wake can be chosen to minimize the periodic loads on the rotors. This reduction in the unsteady loading will diminish blade rate harmonic tones.

SUMMARY OF THE INVENTION

It is a general purpose and object of the present invention to reduce or eliminate the radiated noise signature of rotors.

The above object is accomplished with the present invention through the use of a flapping motion of the movable trailing edge of a stator blade in order to fill its mean wake deficit to reduce unsteady loading on the rotor blades. Interaction between the rotor blades and the discrete vortices in the flapping stator wake may increase unsteady loading on the rotor without careful timing. Through active control of the stator oscillations the timing of rotor blades passing through the wake can be chosen to minimize the periodic loads on the rotors. This reduction in the unsteady loading will diminish blade rate harmonic tones.

BRIEF DESCRIPTION OF THE DRAWINGS

A more complete understanding of the invention and many of the attendant advantages thereto will be more readily appreciated by referring to the following detailed description when considered in conjunction with the accompanying drawings, wherein like reference numerals refer to like parts and wherein.

DETAILED DESCRIPTION OF THE INVENTION

Figure 1:
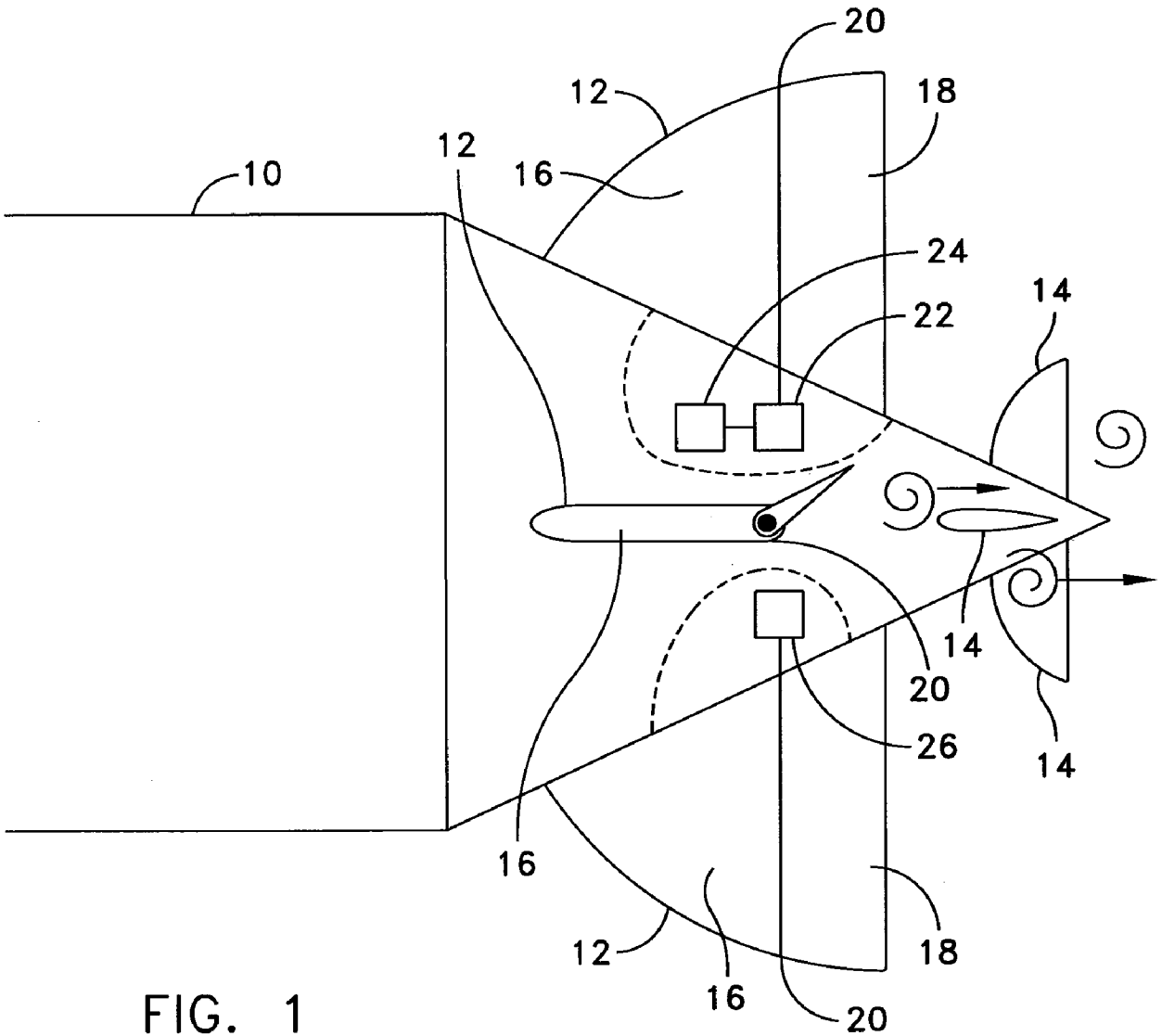
FIG. 1 illustrates the present invention of oscillating trailing edges of stator blades as implemented on the hull of a submersible vehicle.

Referring to FIG. 1 there is illustrated a diagram of the present invention as implemented on the hull of a submersible vehicle. The vehicle hull 10 has on its stern a series of stator blades 12. The stator blades 12 are designed to be in a fixed position on the vehicle hull 10. As the submersible vehicle is propelled through water, the stator blades 12 have a tendency to induce a swirl in the water surrounding the stator blades 12. The vehicle hull 10 also has on its stern a series of rotor blades 14. The rotor blades 14 are designed to rotate around an axis point within the vehicle hull 10 to propel the vehicle. The flapping stator mechanism of the present invention is upstream of the rotor blades on a submersible vehicle. The stator blade 12 is made of two parts: the static leading edge 16 and the oscillating trailing edge 18 which pivots about a shaft 20 where it meets the static leading edge 16 piece. The pivot of the trailing edge 18 runs into the hull where the shaft 20 is connected to a motor 22 within the vehicle hull 10. A motor 22 and cam 24 actuate the trailing edge 18 to produce the oscillating motion. Alternatively, a direct drive 26 can be used instead of a cam 24 for the trailing edge 18 oscillations to provide more control over amplitude and allow more transient, non-periodic motions if desired.

When oscillating, the trailing edge 18 of the stator blade 12 periodically pitches back and forth to produce a thrust vortex street that fills its wake deficit. The flapping motion of the trailing edge 18, a sinusoidal oscillation of the flap on an otherwise fixed wing, only produces thrust to compensate for the stator blade 12 drag, an inconsequential amount of drag relative to the total vehicle drag. It is not for propulsive purposes. Depending on the timing between the rotor blades 12 and the shed vorticity from the stator, the unsteady forces on the rotor blades 12 may be reduced. Active control is used to alter the frequency and/or amplitude of the motion of the trailing edge 18 to fill the wake depending on inflow velocity speed and necessary timing between shed vortices and the rotor blades 14. Active control of the stator wakes diminishes unsteady loading of the rotor blades, reducing blade rate tonal noise.

Figure 2:
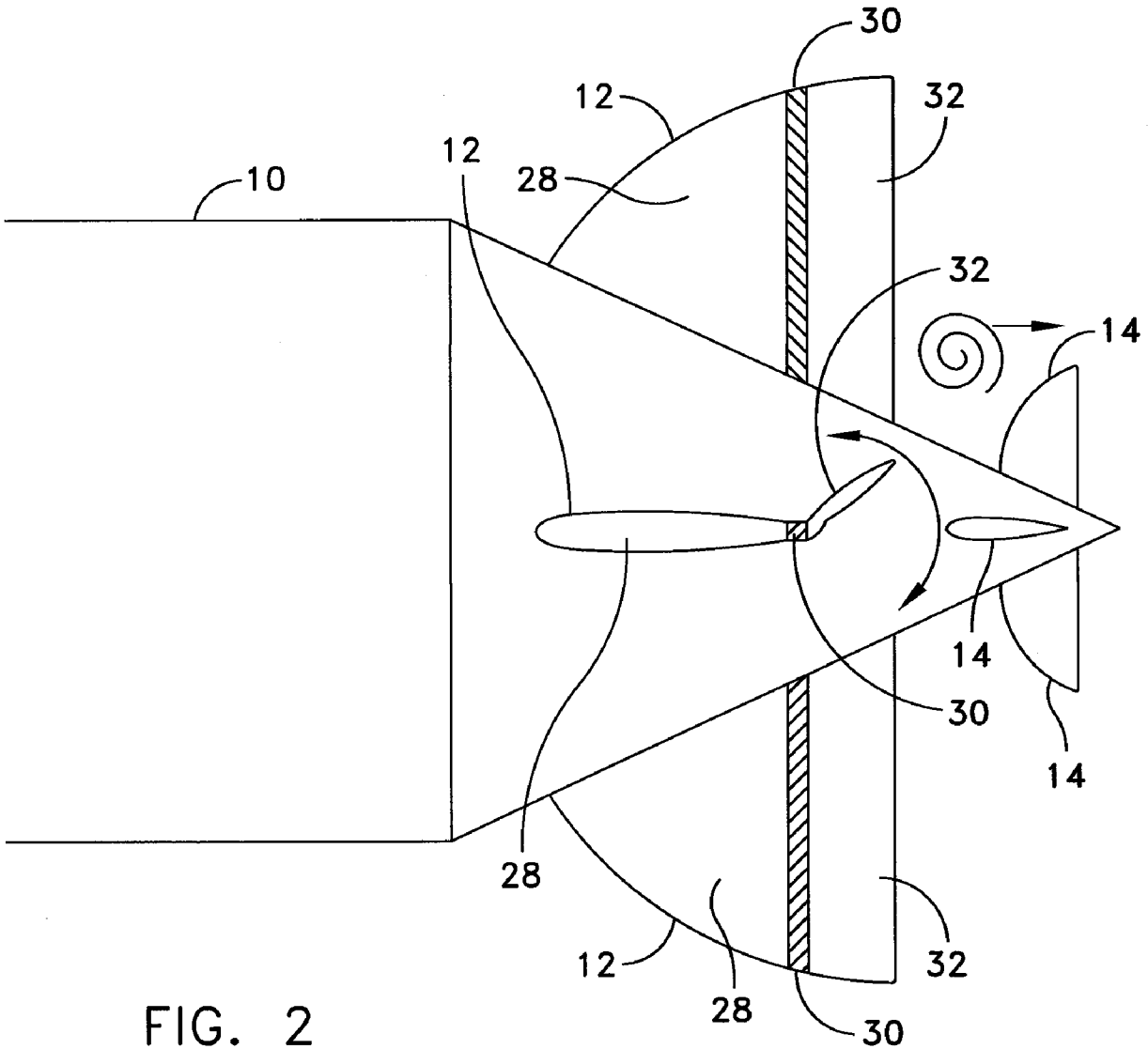
FIG. 2 illustrates an alternative embodiment of the present invention using compliant muscle wires.

In an alternative embodiment as illustrated in FIG. 2, artificial muscle technology can be used to oscillate the stator trailing edge while allowing the stator to be one seamless piece consisting of a rigid leading edge 28, compliant muscle wires 30 and rigid trailing edge 32.

The advantage of the present invention is that it can reduce blade tonal noise signatures through a simple actuation of the stator trailing edge in a propulsor that involves rotor blades passing through the wakes of stators, guide vanes, control fins and other appendages.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. An apparatus for controlling stator wakes on an underwater vehicle comprising:

a plurality of rotatable rotor blades joined to a stern end of a hull of the underwater vehicle;

a plurality of static stator blades joined to the stern end of the hull of the underwater vehicle, wherein the stator blades are located upstream relative to the rotor blades, wherein each stator blade has a static leading edge and an oscillating trailing edge joined to said static leading edge;

a shaft having a first end located within the hull of the underwater vehicle joined to said oscillating trailing edge located where the oscillating trailing edge meets the static leading edge of each of said plurality of stator blades; and a means for actuating said shaft to produce a controlled sinusoidal oscillation of the oscillating trailing edge of each of said plurality of stator blades periodically to produce a thrust vortex street that fills a wake deficit for each of said plurality of stator blades wherein active control is used to alter the frequency and/or amplitude of the motion of the oscillating trailing edge to fill the wake depending on inflow velocity speed and necessary timing between shed vortices and the plurality of rotor blades.

2. The apparatus of claim 1 wherein the means for actuating said shaft to produce a controlled sinusoidal oscillation of the oscillating trailing edge of each of said plurality of stator blades is a motor and cam.

3. The apparatus of claim 1 wherein the means for actuating said shaft to produce a controlled sinusoidal oscillation of the oscillating trailing edge of each of said plurality of stator blades is a direct drive.

4. An apparatus for controlling stator wakes on an underwater vehicle comprising:

a plurality of rotatable rotor blades joined to a stern end of a hull of the underwater vehicle;

a plurality of static stator blades joined to the stern end of the hull of the underwater vehicle, wherein the stator blades are located upstream relative to the rotor blades, wherein each stator blade has a static leading edge and an oscillating trailing edge joined to said static leading edge; and a plurality of compliant muscle wires that join the oscillating trailing edge with the static leading edge of each of the plurality of static stator blades wherein said complain muscle wires act as a means for actuating said oscillating trailing edge to produce a controlled sinusoidal oscillation of the oscillating trailing edge of each of said plurality of stator blades periodically to produce a thrust vortex street that fills a wake deficit for each of said plurality of stator blades wherein active control is used to alter the frequency and/or amplitude of the motion of the oscillating trailing edge to fill the wake depending on inflow velocity speed and necessary timing between shed vortices and the plurality of rotor blades.

* * * * *